US007882713B2

(12) United States Patent
Tseng

(10) Patent No.: US 7,882,713 B2
(45) Date of Patent: Feb. 8, 2011

(54) LENGTH-WAYS STRETCHABLE ELASTIC BAND

(76) Inventor: Hui Tseng, 18F, No. 216, Sec. 2, Dun Hua South Road, Taipei (TW)

( * ) Notice: Subject to any disclaimer, the term of this patent is extended or adjusted under 35 U.S.C. 154(b) by 445 days.

(21) Appl. No.: 12/076,205

(22) Filed: Mar. 14, 2008

(65) Prior Publication Data

US 2008/0163408 A1 Jul. 10, 2008

Related U.S. Application Data

(63) Continuation-in-part of application No. 11/102,782, filed on Apr. 11, 2005, now abandoned.

(30) Foreign Application Priority Data

Mar. 16, 2005 (TW) ..... 94204065 U

(51) Int. Cl.
*D04B 1/18* (2006.01)

(52) U.S. Cl. ..... 66/172 E

(58) Field of Classification Search ..... 66/171, 66/173, 180, 172 E, 172 R, 170
See application file for complete search history.

(56) References Cited

U.S. PATENT DOCUMENTS 2,301,540 A * 11/1942 Herb ..... 66/172 E
2,977,782 A * 4/1961 Sheek ..... 66/173
3,625,029 A * 12/1971 Safrit et al. ..... 66/142
4,047,400 A * 9/1977 Thorneburg ..... 66/171
4,499,741 A * 2/1985 Harris ..... 66/171
4,910,804 A * 3/1990 Lidgren ..... 2/209.3
5,963,988 A * 10/1999 Jackson, Jr. ..... 2/243.1
6,499,144 B1 * 12/2002 Yan ..... 2/181.2
6,625,818 B2 9/2003 Putnam

* cited by examiner

*Primary Examiner*—Danny Worrell
(74) *Attorney, Agent, or Firm*—Birch, Stewart, Kolasch & Birch, LLP

(57) ABSTRACT

A lengthways stretchable elastic band having two edges is provided. The elastic band comprises a plurality of longitudinal elastic yarn segments and at least one elastic thread area, which extends to the two edges of the elastic band. The plurality of longitudinal elastic yarn segments are made of elastic yarns and the elastic thread area is made of elastic threads. The elastic band is formed by connecting the plurality of longitudinal elastic yarn segments together using the elastic thread area. The elastic thread area connects the plurality of longitudinal yarn segments by tying the ends of the elastic threads to the ends of the elastic yarns. As such, when the elastic band is under a force, it can be expanded both lengthways and sideways, thereby obtaining multi-directional extensibility.

3 Claims, 9 Drawing Sheets

LENGTH-WAYS STRETCHABLE ELASTIC BAND

This application is a Continuation-In-Part of application Ser. No. 11/102,782 filed on Apr. 11, 2005 now abandoned claims priority under 35 U.S.C. §119(a) on Patent Application No(s). 094204065 filed in Taiwan on Mar. 16, 2005, the entire contents of which are hereby incorporated by reference.

RELATED APPLICATION

The present application is a Continuation-in-Part of Ser. No. 102,782 filed Apr. 11, 2005.

BACKGROUND OF THE INVENTION (a) Technical Field of the Invention

The present invention relates to a lengthways stretchable elastic band structure, which allows an elastic band to stretch sideways as well as lengthways, thereby expanding the stretchable area of the elastic band. The invention can be applied to headgears such as headbands and cap bands for better fitting and functionality when worn by a user.

(b) Description of the Prior Art

When performing exercises, people often utilize a headband to hold their hair to prevent the hair from interfering their exercises, and to absorb sweat. Generally, a headband is made of fabrics that have good absorption, and is provided with a stretchable elastic band so that the headband can fit the user's head properly and comfortably. Such headband allows the user to easily put on and avoid the feeling of having something tied to his/her head.

As caps not only can serve the purposes of shading rain and sun, but also can be used to match clothing for various styles, they are popular amoung consumers.

Taking a cap structure for example, the conventional structure of a cap is provided with a peak made of soft plastic, the top of which is combined to a crown having an elastic band at the rear end. By way of the tension of the elastic band, the cap can be fitted to users of various head sizes. Therefore, the extensibility of the elastic band is an extremely important requirement of headgear products.

In the prior art under U.S. Pat. No. 6,625,818, the key point of the design thereof is an elastic band including layers of stretchable fabrics and elastic stitching, such that when the elastic band is pulled by force, the area thereof will expand. However, as the layers of fabrics are secured by the elastic stitching in a lengthways direction of the elastic band, the lengthways stretch ability of the elastic band is the smallest of all the fabrics and the stitching, which could be none since the fabrics may be uniaxially or multiaxially stretchable as disclosed in the patent specification.

Since the lengthways stretch ability of the elastic band is limited by the material, the choice of materials for the elastic band is also limited. When improper materials are selected and the lengthways stretch ability is poor, a user may feel restrained when wearing a wrong size elastic band on the head, and gradually feel stressed after a period of time.

Accordingly, the inventor has a motive to improve the elastic bands of the prior art to allow the user to wear the elastic band products, such as headbands and headgears, comfortably without feeling restrained or stressed.

SUMMARY OF THE INVENTION

The primary purpose of the present invention is to provide a lengthways stretchable elastic band, which can stretch in multiple directions, such that when mounted on a user's head, the user would feel comfortable.

Another object of the invention is to provide a lengthways stretchable elastic band, which, when being applied to a headband, can be easily bound to the user's forehead for holding the hair and/or absorbing the sweat without pressuring the user's head.

A further object of the invention is to provide a lengthways stretchable elastic band, which can be applied to a headgear, such that the size of the headgear band can be freely adjustable depending on the periphery of the user's head to prevent the headgear from coming off easily.

A further object of the invention provides a lengthways stretchable elastic band, comprising a first longitudinal elastic yarn segment; a second longitudinal elastic yarn segment, wherein the first and second longitudinal elastic yarn segments are knitted by elastic yarns; and at least one elastic thread area, knitted by elastic threads, connecting the first and second longitudinal elastic yarn segments by tying the ends of the elastic threads to the ends of the elastic yarns of the first and second longitudinal elastic yarn segments, wherein the elastic thread area extends to two edges of the elastic band.

A further object of the invention provides a lengthways stretchable elastic band having two edges, comprising a plurality of longitudinal elastic yarn segments, made of elastic yarns; and at least one elastic thread area, made of elastic threads, connecting the plurality of longitudinal elastic yarn segments by tying the ends of the elastic threads to the ends of the elastic yarns of the plurality of longitudinal elastic yarn segments, wherein the elastic thread area extends to the two edges of the elastic band.

A further object of the invention provides a lengthways stretchable elastic band composed of plural longitudinal elastic yarn segments and elastic thread areas which are formed via knitting and sewing, wherein two of the adjacent longitudinal elastic yarn segments are connected by elastic threads to form the elastic band, and the elastic threads extend across two edges of the elastic band.

When the elastic band is forced, it can be expanded lengthways and sideways, thereby obtaining a multidirectional extensibility. Meanwhile, the elastic band would have an outer appearance full of unique visual effect like a thread ribbon that makes the elastic band productions more fine and delicate.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability, or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
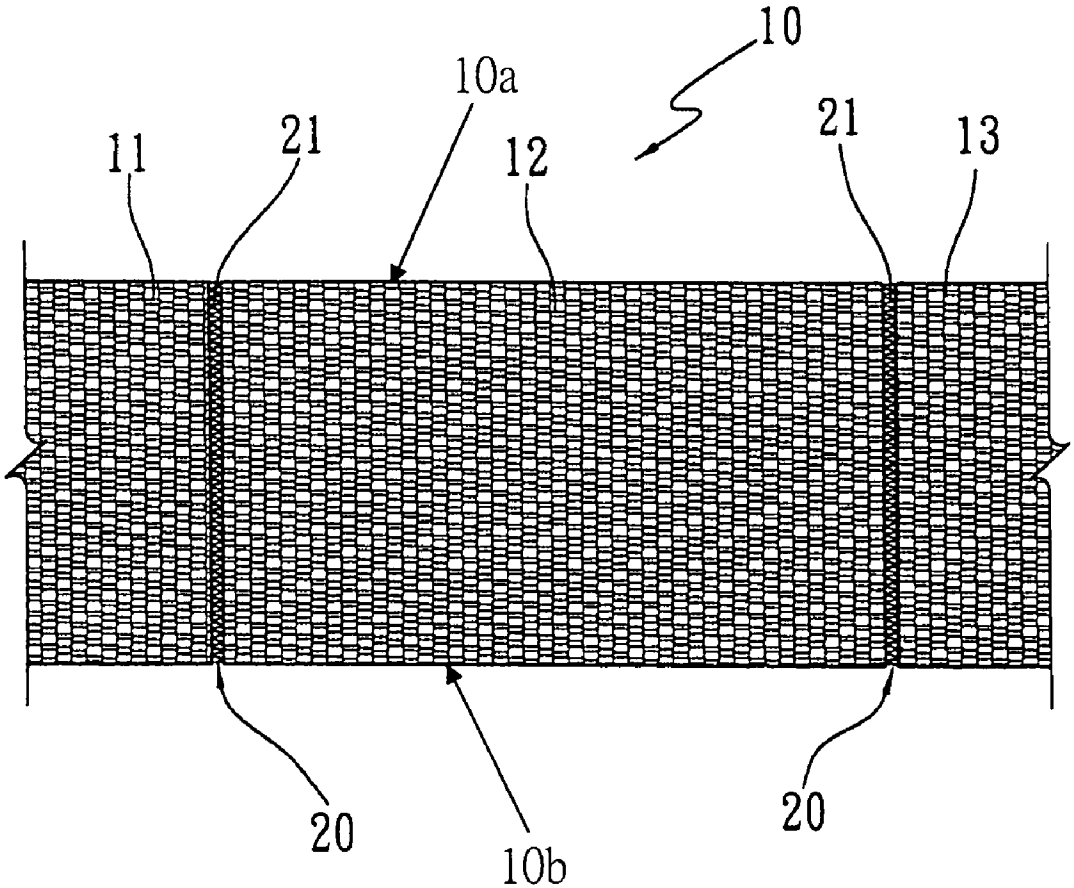
FIG. 1 is a perspective view of the elastic band according to the present invention.
Figure 2:
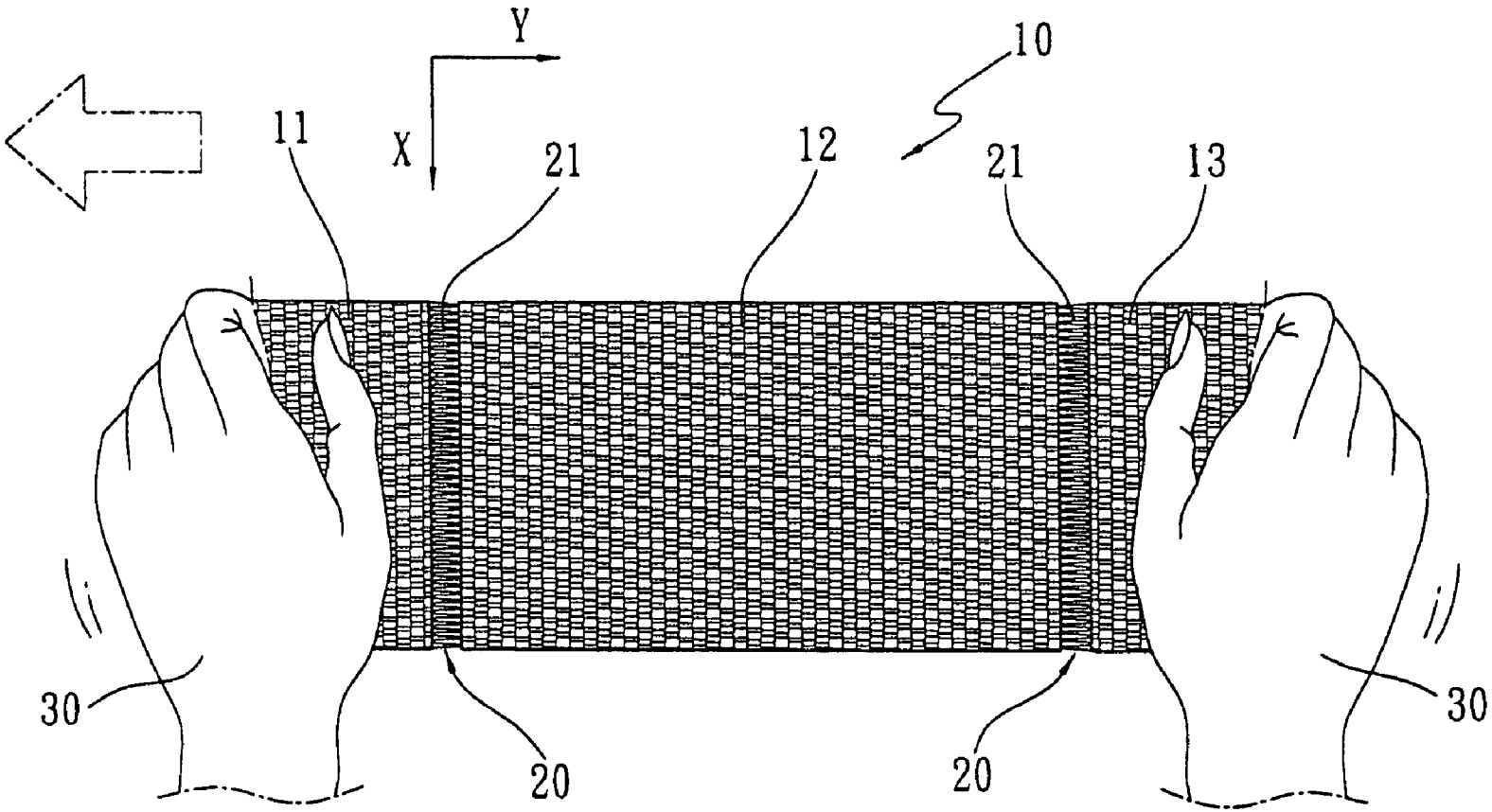
FIG. 2 shows the elastic band under a lengthwise force.
Figure 3:
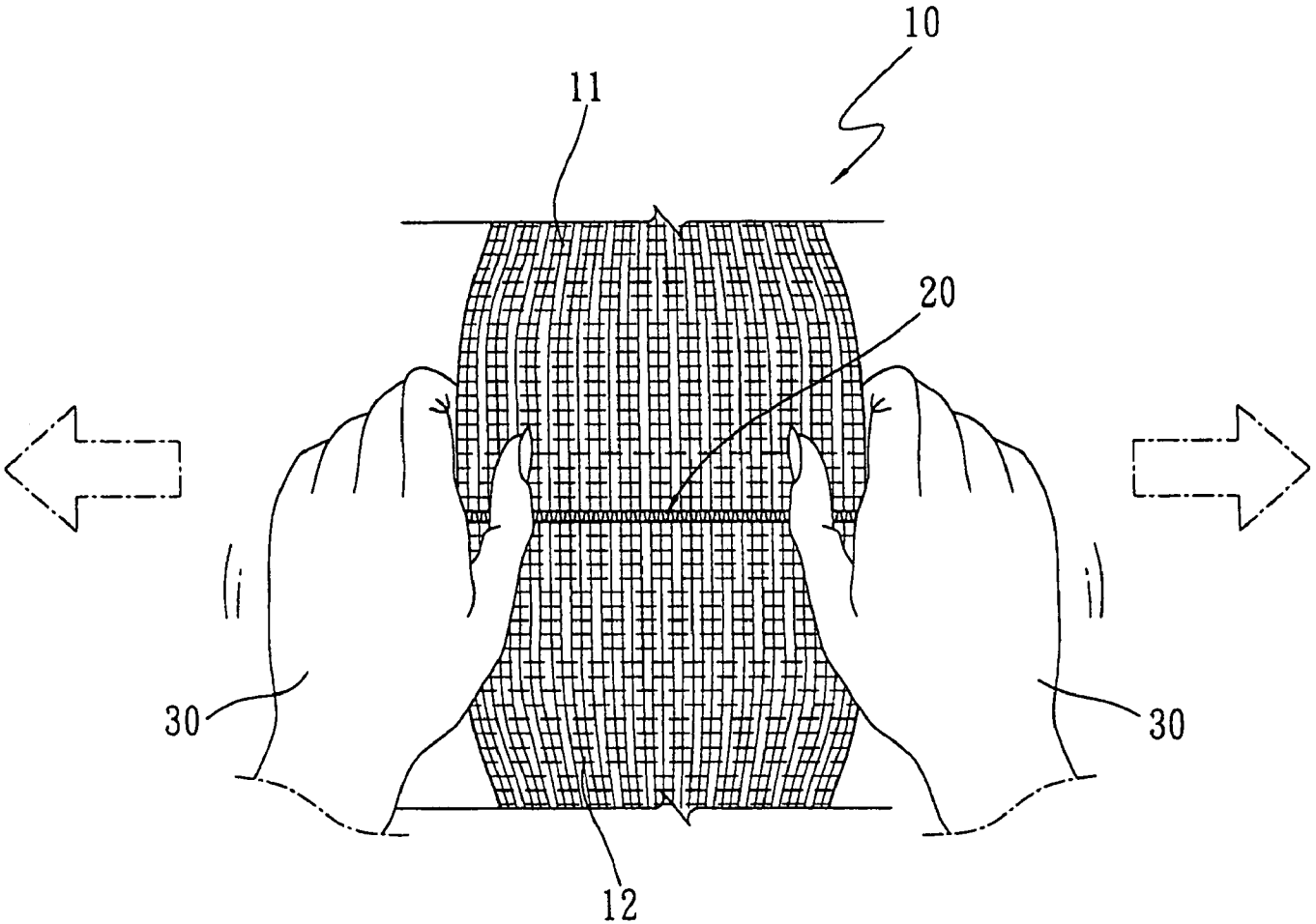
FIG. 3 shows the elastic band under a sideway force.

Referring to FIG. 1, the elastic band 10 of the invention is composed of plural longitudinal elastic yarn segments (11, 12, 13 . . . ) and the longitudinal elastic yarn segments (11, 12, 13 . . . ) form an encircling strip via knitting and sewing. The longitudinal elastic yarn segments may also form the encircling strip with other materials. The longitudinal elastic yarn segments (11, 12, 13 . . . ) may be fabrics or fibers having specific and appropriate extensibility, and the two adjacent longitudinal elastic yarn segments (11, 12, 13 . . . ) are connected by elastic thread areas 20, which are made of elastic threads 21, and the elastic thread areas 20 extend across two edges (10*a*, 10*b*) of the elastic band. While the longitudinal elastic yarn segments (11, 12, 13 . . . ) are connected to one another via lengthways knitting and sewing, during the process of sewing/knitting a first longitudinal elastic yarn segment 11 and a second longitudinal elastic yarn segment 12, or the second longitudinal elastic yarn segment 12 and a third longitudinal elastic yarn segment 13, as shown, the elastic threads 21 therebetween are lengthways knitted from top to bottom, and therefore has a direction X vertically intersects the direction Y that the elastic band 10 is to be extended. Accordingly, when the elastic band 10 is under a force of the user's hands 30, it can be expanded lengthways (as shown in FIG. 2) and sideways (as shown in FIG. 3) depending on the direction of the force exerted thereon, thereby obtaining a multi-directional extensibility. Meanwhile, the elastic band 10 would have an outer appearance full of unique visual effect like a thread ribbon that makes the elastic band productions more fine and delicate.

As depicted above, when the elastic band 10 is under a force, the meshes of the longitudinal elastic yarn segments (11, 12, 13 . . . ) will expand (as shown in FIG. 3). Nevertheless, any position on the longitudinal elastic yarn segments (11, 12, 13 . . . ) would not occur any constraint by the lines due to the pulling force exerted to the elastic threads 21. Therefore, when the elastic band 10 is worn by the user, he/she would feel comfortable without any constraint, though, in fact, he/she is wearing an elastic band 10. Regarding the elastic thread areas 20, they can appropriately expand, no matter they are exerted sideways or lengthways. It is worth a further emphasis that the elastic band 10 would have an outer appearance full of visual effect as elegant as a delicate thread ribbon.

Figure 4:
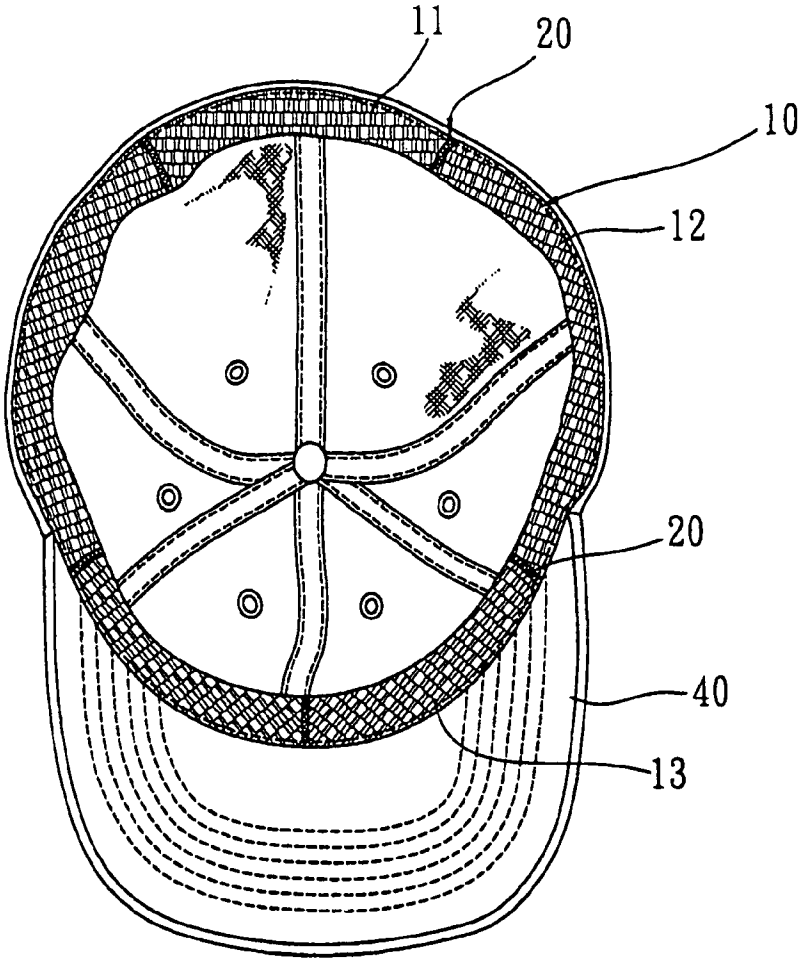
FIG. 4 shows the combination of the elastic band to a cap.

Referring to FIG. 4, the character of the elastic band 10 structure according to the invention can be applied to headgear products. As shown, the elastic band 10 is integrally sewn to the inner rim of a cap 40, such that the elastic band 10 is also serviceable as a sweatband that can be freely adjusted to fit the size of the user's head.

Figure 5:
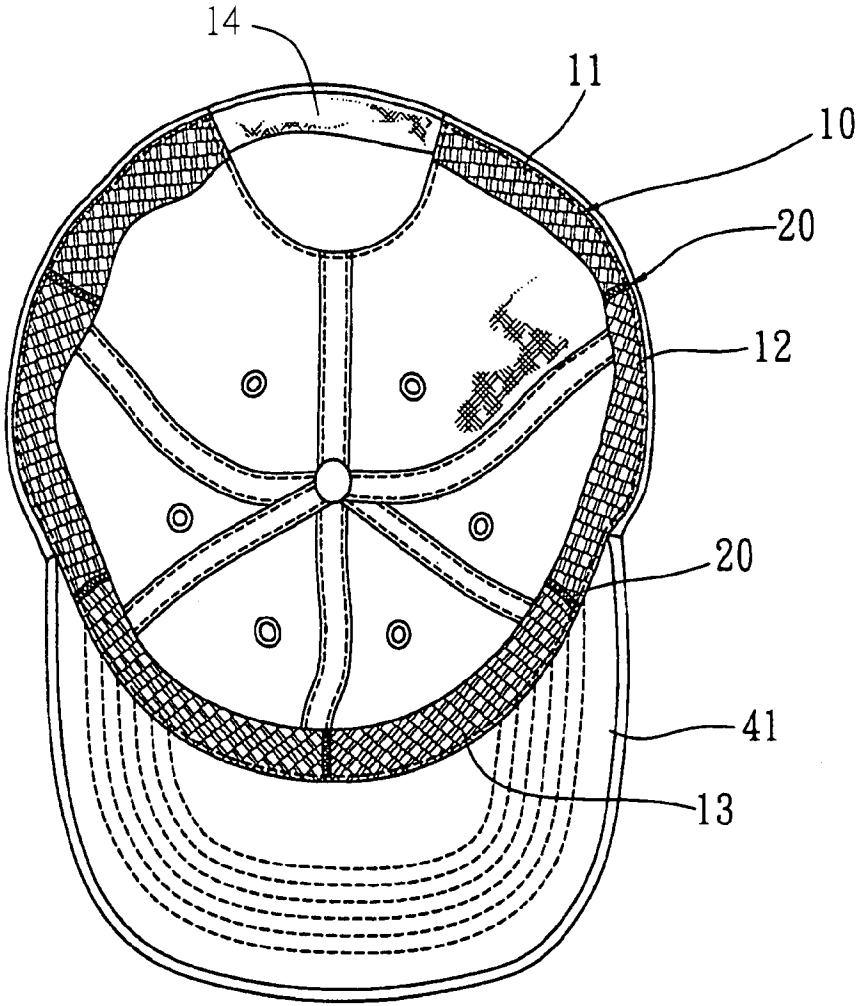
FIG. 5 shows the combination of another embodiment of the invention to a cap.

FIG. 5 shows another embodiment of the invention. The elastic band 10 is sewn to the inner rim of the cap 41 with an area of the rear band being a piece of cloth 14. The piece of cloth 14 may be elastic or inelastic materials, such as silk, elastic fiber, elastic fabric, inelastic fiber, or inelastic fabric. Likewise, the elastic band 10 can be serviceable as a sweatband.

Figure 6:
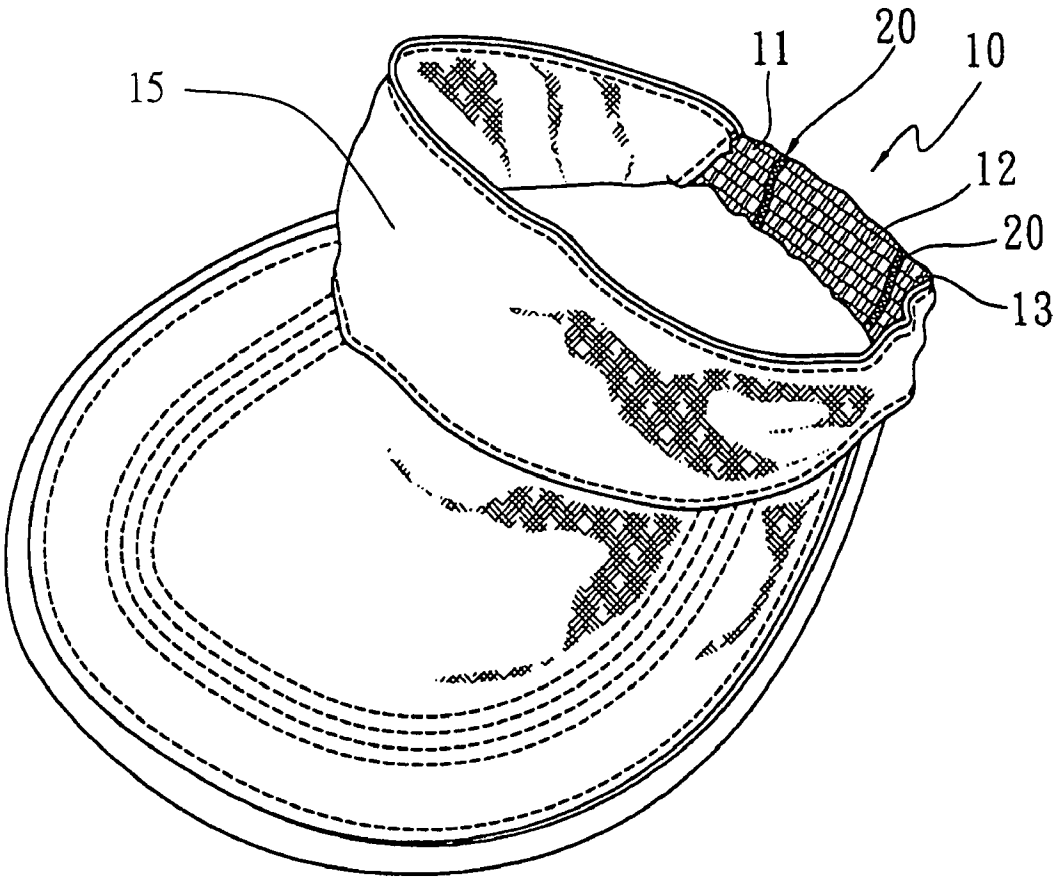
FIG. 6 shows the combination of a further embodiment of the invention to a sun visor.

As shown in FIG. 6, the invention is applied to a tennis cap (sun visor). The front end of the elastic band 10 is a piece of cloth 15. The piece of cloth 14 may be elastic or inelastic materials, such as silk, elastic fiber, elastic fabric, inelastic fiber, or inelastic fabric.

Figure 7:
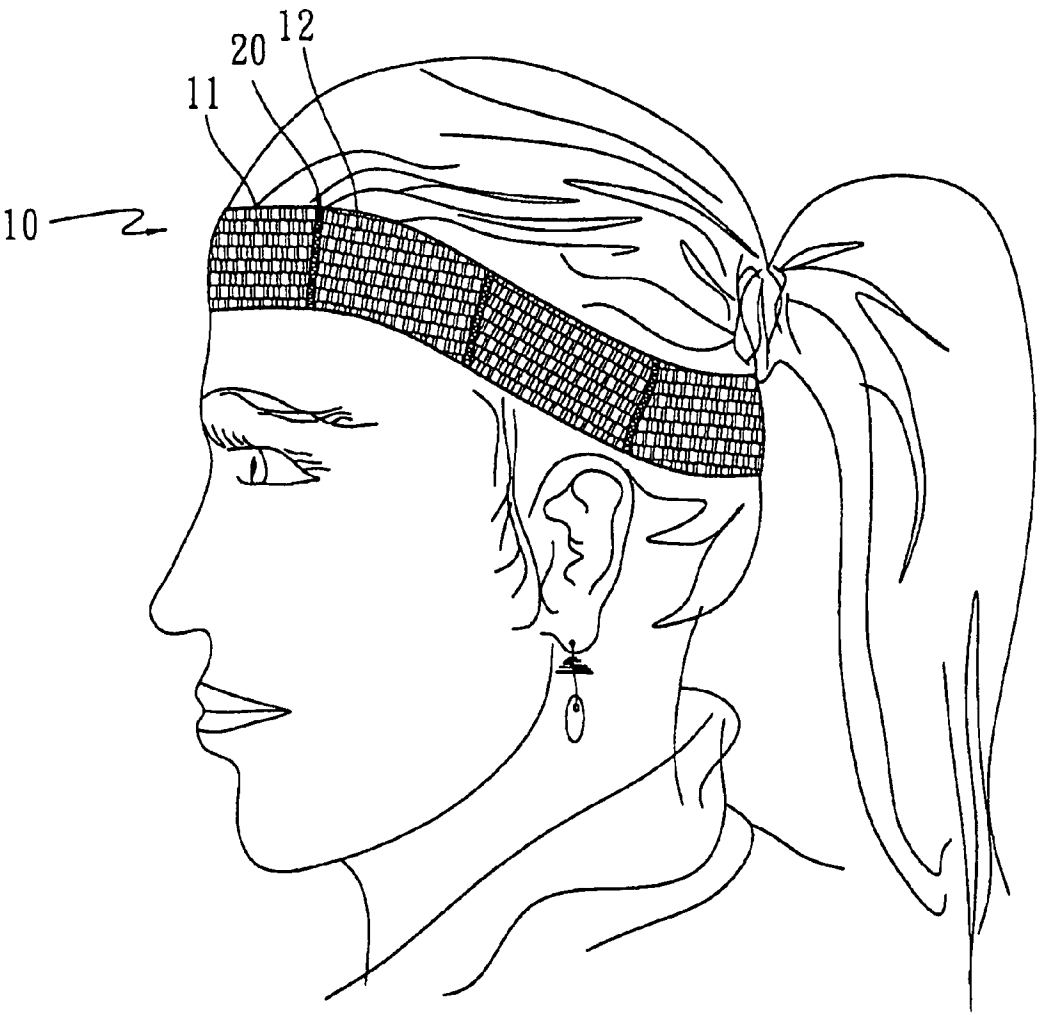
FIG. 7 shows an exemplified application of the invention, serving as a headband.

As shown in FIG. 7, the invention is applied to a headband. The elastic band 10 is composed of plural longitudinal elastic yarn segments (11, 12, 13 . . . ) and the longitudinal elastic yarn segments (11, 12, 13 . . . ) form an encircling strip, wherein the elastic thread areas 20 extend across the two edges (10*a*, 10*b*) of the elastic band 10 formed via knitting and sewing. The elastic thread areas 20 can be alternatively knitted to form patterns, thereby accomplishing an aesthetic visual effect. Meanwhile, the headband can perfectly fit with the user's forehead.

Figure 8:
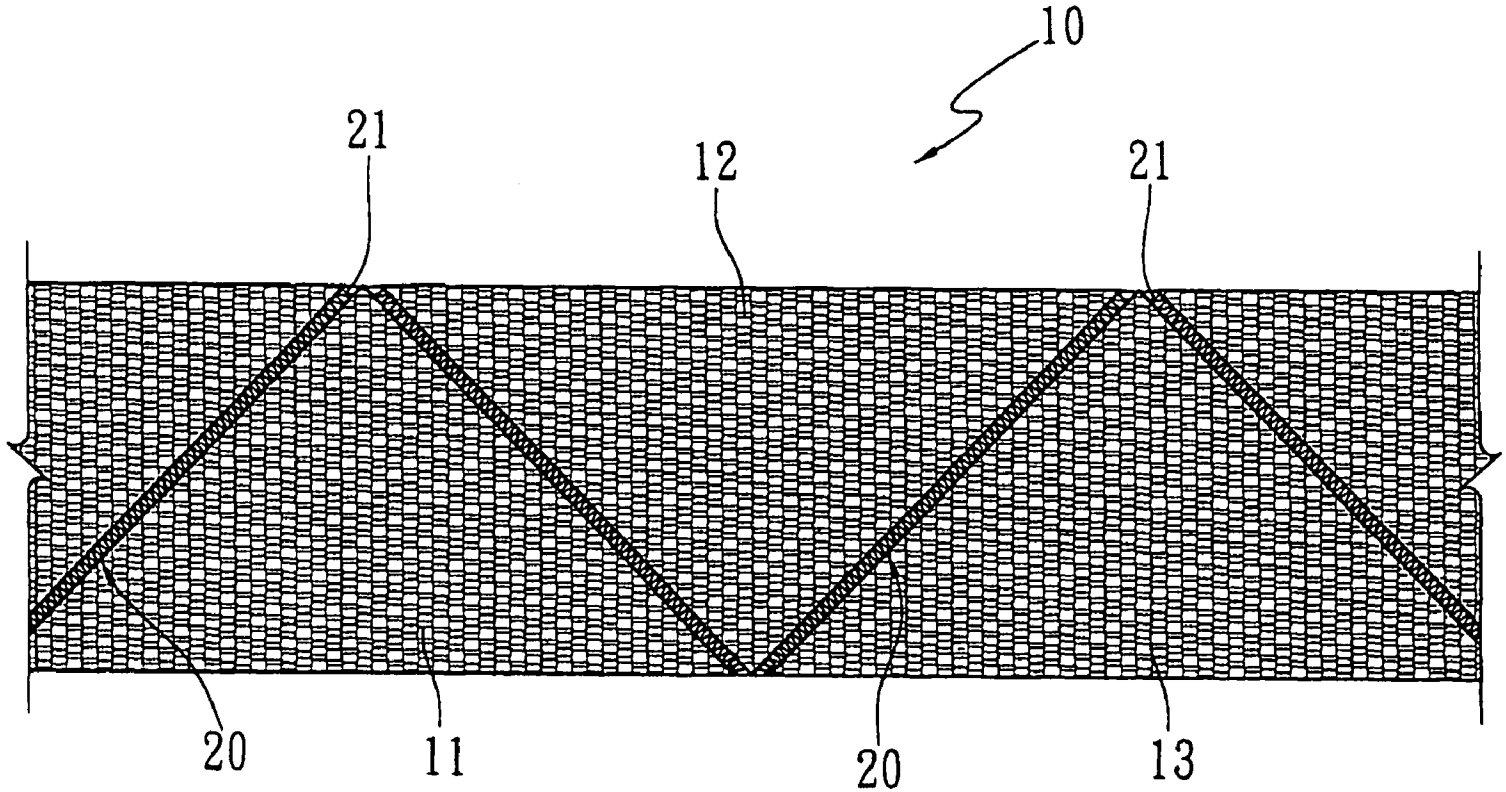
FIG. 8 is a perspective view of a further embodiment of the invention, showing the elastic band in form of oblique knitting.

FIG. 8 shows another preferred embodiment of the invention. The longitudinal elastic yarn segments (11, 12, 13 . . . ) can be cut into triangles, such that the sides of each longitudinal elastic yarn segments (11, 12, 13 . . . ) will become oblique. In other words, in this preferred embodiment, the elastic thread areas 20 are inclined relative to the encircling strip. In the other words, the elastic thread areas 20 are not perpendicular to the two edges (10*a*, 10*b*) of the elastic band 10. Specifically, the longitudinal elastic yarn segments (11, 12, 13 . . . ) are triangular in shapes, the adjacent elastic yarn segments (11, 12, 13 . . . ) are wedged side by side. As such, the elastic threads 21 of the elastic thread areas 20 for connecting the oblique sides of each the longitudinal elastic yarn segments (11, 12, 13 . . . ) should be knitted and sewn in oblique angles, thereby when the elastic band 10 is under a widthwise and lengthwise force, the elastic thread areas 20 can evenly bear the force.

Figure 9:
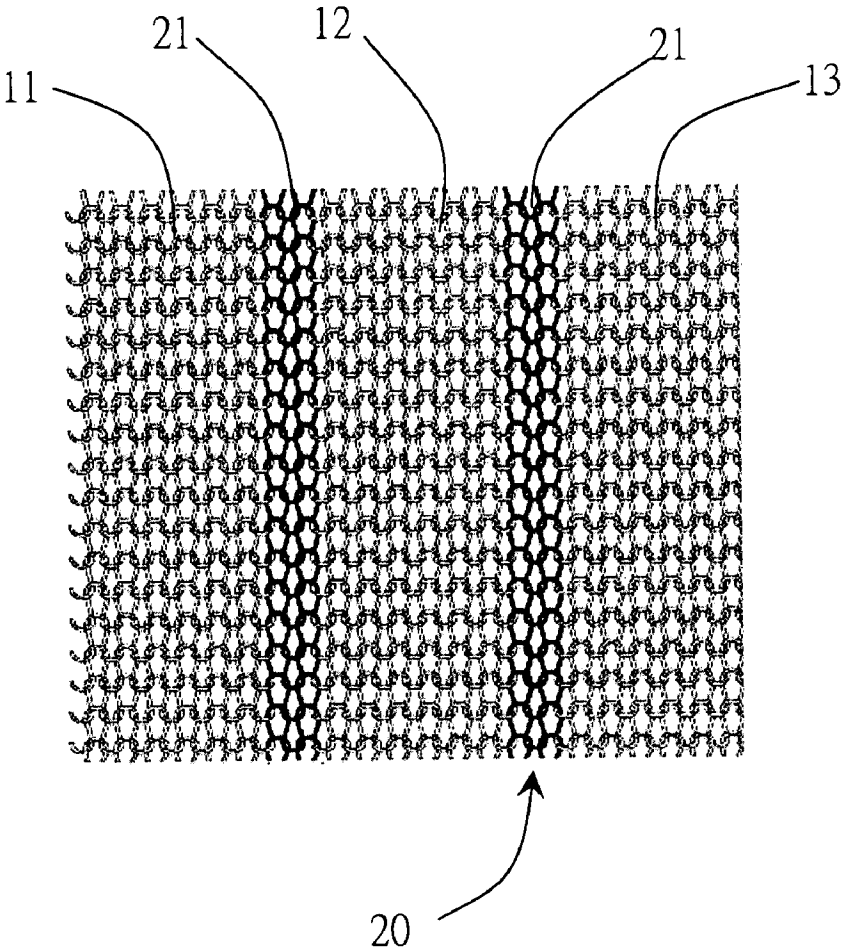
FIG. 9 is a detail view of the elastic band according to the present invention.

FIG. 9 is a blown up of a portion of FIG. 1 and depicts how the longitudinal elastic yarn segments (11, 12, 13 . . . ) and the elastic threads 21 are knitted and sewn together. In the present embodiment, the elastic band 10 is knitted via full needle. The longitudinal elastic yarn segments (11, 12, 13 . . . ) and the elastic thread 21 are knitted together by way of intarsia, where fabrics or fibers are knitted and then tied/connected together at the ends of the fabrics or fibers. The types of fabrics and fibers may vary. As an example, the longitudinal elastic yarn segments (11, 12, 13 . . . ) may be 100% cotton and the elastic thread areas 20 may be 100% rubber. However, all fabrics and fibers with elasticity could be used. In other words, the intarsia is sewed with every two adjacent needles, such as adjacent needles at the longitudinal elastic yarn segments (11, 12, 13 . . . ) or adjacent needles between the elastic threads 21 and the longitudinal elastic yarn segments (11, 12, 13 . . . ).

In the different embodiments, the lengthways stretchable elastic band further comprises a piece of textile connected to the longitudinal elastic yarn segments (11, 12, 13 . . . ) to form the elastic band 10. The piece of textile such as cloth, woof, etc. made of an inelastic fabric, an elastic fiber or other synthesized fabrics.

Concluded above, the present invention can improve the disadvantages existing in the prior art that the force exerted thereon would only focus on a certain position. In the present invention, when the elastic threads are elastic materials such as 100% rubber, the entire elastic band is able to expand lengthwise, allowing a better fit to a user's head or wrist. Furthermore, in view of the fact that the elastic thread areas 20 can be knitted in various directions, the outer appearance of the elastic band 10 may have variations for matching with various clothing styles. Accordingly, the utility of the invention, such as application to headgear products including caps and headbands, is doubtless.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

What is claimed is:

1. A lengthways stretchable elastic band, composed of plural longitudinal elastic yarn segments and elastic thread areas which are formed via knitting and sewing, wherein two of the adjacent longitudinal elastic yarn segments are connected by elastic threads to form the elastic band, and the elastic threads extend across two edges of the elastic band, wherein the elastic threads are inclined relative to the elastic band formed, the longitudinal elastic yarn segments are shaped in triangles, and the adjacent elastic yarn segments are wedged side by side via the elastic threads.

2. The lengthways stretchable elastic band as claimed in claim 1, wherein the longitudinal elastic yarn segments are identical in width.

3. The lengthways stretchable elastic band as claimed in claim 1, wherein the longitudinal elastic yarn segments are different in width.

* * * * *